US006832944B2

(12) United States Patent
Ostrow

(10) Patent No.: US 6,832,944 B2
(45) Date of Patent: Dec. 21, 2004

(54) WAVE TRANSMISSION MOBILE

(76) Inventor: Laurence Jeffrey Ostrow, 71 Mariner Green Dr., Corte Madera, CA (US) 94925

( * ) Notice: Subject to any disclaimer, the term of this patent is extended or adjusted under 35 U.S.C. 154(b) by 0 days.

(21) Appl. No.: 10/600,274

(22) Filed: Jun. 20, 2003

(65) Prior Publication Data

US 2004/0005840 A1 Jan. 8, 2004

Related U.S. Application Data

(60) Provisional application No. 60/390,695, filed on Jun. 21, 2002.

(51) Int. Cl.[7] ..... A63H 33/00

(52) U.S. Cl. ..... 446/236; 40/430; 40/473; 40/617

(58) Field of Search ..... 446/227, 236, 446/243; 40/427, 429, 430, 470, 473, 617

(56) References Cited

U.S. PATENT DOCUMENTS

| | | | | | |
|---|---|---|---|---|---|
| 3,983,647 | A | * | 10/1976 | Stubbmann | 40/430 |
| 4,330,953 | A | * | 5/1982 | Damiano | 40/407 |
| 4,517,758 | A | * | 5/1985 | Thompson | 40/431 |
| 4,567,682 | A | * | 2/1986 | Hurxthal | 40/617 |

* cited by examiner

*Primary Examiner*—Jacob K. Ackun Jr.
(74) *Attorney, Agent, or Firm*—David E. Lovejoy

(57) ABSTRACT

Parallel ribs are aligned and clamped onto a vertical spine, which is a slow-wave discrete-element torsional transmission line. The spine is attached to a motor which may remain ON for extended periods or which be operated by a chip or other mechanical or electronic means which turns the motor ON and OFF at variable intervals, causing the spine to twist, affecting an apparent spiral motion through the length of spine as the ribs rotate. The motor ON and OFF sequencing is set to coordinate with the length and material of the spine and the attached ribs and weights.

14 Claims, 4 Drawing Sheets

WAVE TRANSMISSION MOBILE

This application claims benefit of 60/390,695 filed Jun. 21, 2002

BACKGROUND OF THE INVENTION

The present invention relates to mobiles and particularly to dynamic mobiles driven by a motor.

It is popular these days for people to have many different types of items in homes, offices and other places that, when watched, bring a feeling of calmness and relaxation or which draw attention and interest. These items include aquariums, computer screen-savers with an aquarium or other pleasing image, fountains and waterfalls and they all provide rhythmical wave patterns that can lead to a state of greater relaxation, a sense of peace and calmness. They produce an effect that is similar to the effect of being out at the ocean and watching the waves.

Currently Feng Shui, the Chinese art of creating balanced and healthy living environments, has found acceptance in modem American interior design. They define rhythmically moving mobiles as Chi or energy generating. There is a need for mobiles that operate in pleasing rhythmical ways and that therefore align with Feng Shui's ideas of rhythmical movement of objects and things hanging to create healthier and happier living space.

While there have been many mobiles produced, there still is a need for improved dynamic mobiles that are both pleasing and interesting.

SUMMARY OF THE INVENTION

The present invention is a mobile including an elastic spine having a length extending between a first spine end and a second spine end. A plurality of ribs are spaced apart along the length of the spine, each rib having a long dimension extending between a first rib end and a second rib end where each rib is attached to the spine between the first rib end and the second rib end. A motor is connected to the spine for rotating the spine and the attached ribs to cause the ribs to torque the spine in rotational patterns propagated along the length of the spine.

In the mobile, the ribs are parallel and are aligned and clamped onto the vertical spine. The spine functions as a slow-wave, discrete-element torsional transmission line. The motor which may remain ON for extended periods or may be operated by a chip or other mechanical or electronic means which turns the motor ON and OFF at variable intervals according to a motor sequence. The operation of the motor causes the spine to twist, affecting an apparent spiral motion through the length of spine as the ribs rotate. The motor ON and OFF sequencing is set to coordinate with the length and material of the spine and the attached ribs and weights.

The present invention is a mobile that is a transmission torsion line hung on the vertical axis on a spine that is made from a material that has both lateral as well as longitudinal stretching ability. A material such as neoprene sheets cut in strips works quite well. Though other materials can also be used. Attached to this vertical spine are ribs that come out at an angle that can be 90 degrees but could also be more or less. At one end of the spine is attached a mechanical device that causes the mobile to rotate. At the other side of the spine is a weight of some sort to keep tension on the spine causing the mobile to hang plumb. In addition the mobile could be hung reversed, with the rotating device at the bottom as long as the top is attached to a swivel that puts tension on the spine while also allowing the mobile to rotate.

In the case that a rotation device was not present, or was shut off, the invention could also operate by an individual pushing on one or more of the ribs, giving it an impulse of kinetic energy that would then be transmitted through the invention as a wave pattern.

The rotation device could be on continually, creating a more or less helix pattern in the mobile. This helix pattern is formed through the use of the elastic spine that allows the invention to fall behind itself as it is rotating. The ribs then reveal this pattern of falling behind, but always in order, as a helix pattern. This helix pattern is in dynamic equilibrium when the motor is continually rotating. In addition, through some mechanical manner, an intermittent action of rotation can be generated to add greater complexity to the wave pattern of the mobile. This is through an intermittent feature in the rotation device, as a timer or circuitry, or through, in some way, holding back one of the ribs and then freeing it in a periodic pattern.

This intermittent pattern of rotation creates a complex series of wave patterns in the transmission torsion line going in and out of the helix pattern. This leads to greater interest by the observer as the mobile becomes more visually engaging.

At the end of each rib there may be a bead attached to create a more interesting device. Though it is not essential that anything be at the ends of the ribs. These beads can be made of any material such as plastic, wood or leaded glass. If beads are used at the end of the ribs, then they must be balanced, either in weight or by adjusting the place where the rib is joined to the spine, creating what looks visually asymmetrical but is balanced weight wise.

This present invention, a vertically oriented discrete motion torsion line, generates a complex but rhythmical wave pattern produced by the oscillation of the individual ribs as the entire mobile rotates on an elastic spine, that presents itself as a relaxing addition to any living space.

The present invention aligns itself perfectly with Feng Shui's ideas of rhythmical movement of objects and things hanging to create healthier and happier living space.

BRIEF DESCRIPTION OF THE DRAWINGS

FIG. 2 is a frontal view of the mobile in a moving position when the motor is on.

DETAILED DESCRIPTION

Figure 1:
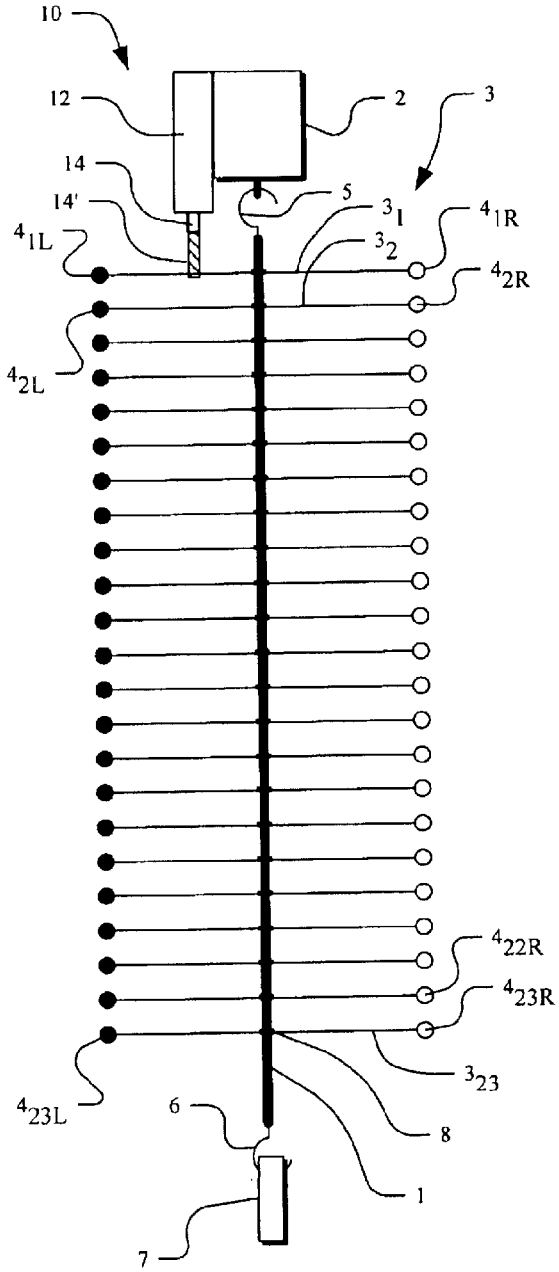
FIG. 1 is a front view of a 23-rib embodiment of a mobile in a stationary position with the motor is off.

In FIG. 1, a frontal view of a 23-rib embodiment of a mobile is shown in a stationary position with the motor off.

The mobile 10 includes a spine 1 and ribs 3 attached and extending perpendicular to the spine 1. In FIG. 1, clips 8 attach the ribs 3 to the spine 1. A hook 5 or similar fastener is located at the top of the spine 1 for attachment to a drive shaft of a motor 2. A hook 6 or similar fastener is located at the bottom of the spine 1 for attachment to a weight 7. The spine 1 is made from an elastic material such as neoprene or other stretchy, rubber-like material. The spine 1 can be of any length and any width and generally is longer then wide. The ribs 3 are made of straight wire such as welding rods, piano wire, wooden or plastic dowels or any other rigid material. At the end of the ribs are rib weights 4 such as beads, balls or any other material that can be attached to the ribs 3. The ribs 3 are attached in any convenient manner so as to be balanced on the spine 1. In one embodiment, each rib 3 is attached by a clip 8. Alternatively, the ribs 3 can be attached through the use of an adhesive such as epoxy. At the top of the mobile, the hook 5 allows for attachment to a drive shaft of a motor 2 so that the spine 1, ribs 3 and weight 7 can hang freely and vertically. At the bottom, the weight 7 is typically a pendant or other pretty object that can be attached to hook 6 to create tension on the spine 1. A weight at the bottom is not essential when the weight of the ribs 3 and rib weights 4 are selected for the desired operation and appearance.

In FIG. 1, ribs 3 include the ribs $\mathbf{3}_1, \mathbf{3}_2, \ldots, \mathbf{3}_{23}$. The ribs 3 are 11 inches long and formed of 0.049 inch diameter piano wire. At the ends of the ribs $\mathbf{3}_1, \mathbf{3}_2, \ldots, \mathbf{3}_{23}$ are rib weights $\mathbf{4}_{1L}, \mathbf{4}_{2L}, \ldots, \mathbf{4}_{23L}$ on the left side and rib weights $\mathbf{4}_{1R}, \mathbf{4}_{2R}, \ldots, \mathbf{4}_{23R}$ on the right side each of about 0.83 inch (21 mm) diameter and weighing about 5 grams. The ribs 3 are spaced along the spine 1 with a 1.25 inch spacing so that the spine length between the first rib $\mathbf{3}_1$ and the last rib $\mathbf{3}_{23}$ is about 27.5 inches. The spine extends with a leader portion from the first rib $\mathbf{3}_1$ to the hook 5 and with a leader portion from the last rib $\mathbf{3}_{23}$ to the hook 6, each leader about 2 inches long, so that the overall length of the spine and hooks is about 32 inches. The spine 1 in the embodiment of FIG. 1 is neoprene measuring about ⅜ inch wide and 1/32 inch thick and having a hardness of 50 durometer. The weight 7 adds enough weight to assist in straightening the spine 1 and attached ribs 3. In the embodiment of FIG. 1, the weight 7 is about 28 grams. The drive motor 2 in the embodiment of FIG. 1 is electrically powered (from batteries or 3 volt power supply). The motor can be an electric motor, a wind-up motor, a solar powered motor or any other kinetically powered turning apparatus. Adjacent or attached to the motor 2 is a plunger 12 that can be manually or automatically actuated to perturb the first rib $\mathbf{3}_1$. When the rod 14 is not actuated, the rib $\mathbf{3}_1$ clears the end of the rod 14 and hence is not disturbed. When plunger 12 is actuated, the rod 14 is extended to the rod 14' position that intersects the rotating path of the rib $\mathbf{3}_1$ and causes the rotation to be perturbed. Such perturbations introduce a traveling wave that becomes superimposed over any existing wave pattern traveling in the mobile.

While the FIG. 1 embodiment depicts a typical mobile, many variations are possible. The number of ribs and the distance between ribs can vary and these variations will affect the over all length of the mobile. Mobile lengths are typically from 3 to 15 feet, but mobiles of 30 feet or more are possible. One requirement is that the spine be strong enough to support the weight of the ribs while being elastic enough to allow rotation of the spine by the ribs.

In FIG. 1, the motor 2 when ON rotates at about about 20 rpm. However, the desired speed of rotation is related to the physical properties of the other components of the mobile. The rotation speed is generally within a range of from 5 to 30 rpm with between 16 to 20 rpm being optimum for 11 inch ribs. For longer ribs, the speed tends to be slower, for example, a 21 inch rib can use a speed of 8 rpm. The longer the rib, the faster the speed of a bead or other rib weight at the end of a rib and hence the greater the momentum and the torsion forces on the spine 1.

The rib dimensions can also vary including diameter, length and shape. The ribs in any particular mobile need not all be the same and may vary from rib to rib in diameter, length or shape. The length of the ribs for small mobiles is typically 11 inches, but the length typically varies from 8 inches to 24 inches or more for spine lengths from 3 to 30 feet. The ribs can be attached to the spine in a number of ways. The ribs can be held on by small clips having the same width as the spine and that allow the rib to be pushed into and sandwiched by the spine. The ribs can also be attached by laminating the ribs between two layers of the spine or glued directly to the spine.

The ribs 3 include may different types of rib weights 4 located at the ends of the ribs or alternatively at different distances along the rib between the spine 1 and the rib end. The rib weights 4 are beads, spheres, stars or any other pleasing shape and made of any material. With reflecting or prism beads, rainbows are formed in sunlight and with other lighting shadows are produced on walls, ceilings and floors. These additions render the mobile further visually engaging with rhythmical patterns that are aesthetically pleasing as well as emotionally calming.

Figure 2:
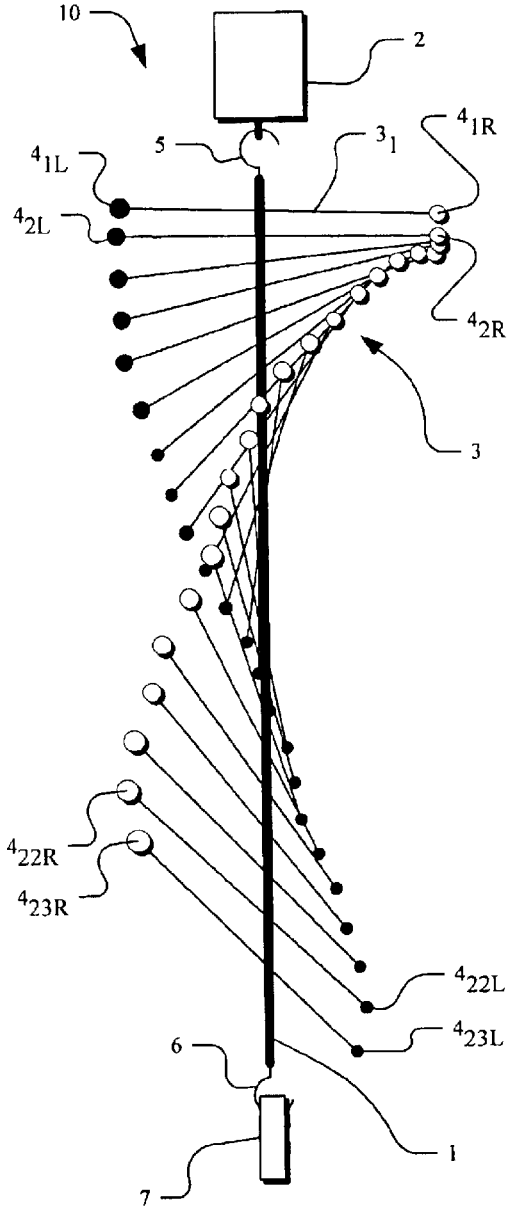

In FIG. 2, a frontal view of a 23-rib embodiment of a mobile is shown in a moving position with the motor on. The FIG. 2 view is a snapshot in an instant of time since the mobile is in continues rotation. The ribs $\mathbf{3}_1, \mathbf{3}_2, \ldots, \mathbf{3}_{23}$ and the rib weights $\mathbf{4}_{1L}, \mathbf{4}_{2L}, \ldots, \mathbf{4}_{23L}$ and the rib weights $\mathbf{4}_{1R}, \mathbf{4}_{2R}, \ldots, \mathbf{4}_{23R}$ have been rotated on spine. The shape formed for each of the rib weights $\mathbf{4}_{1L}, \mathbf{4}_{2L}, \ldots, \mathbf{4}_{23L}$ is that of a helix and the shape formed for each of the rib weights rib weights $\mathbf{4}_{1R}, \mathbf{4}_{2R}, \ldots, \mathbf{4}_{23R}$ so that together a double helix is formed. The FIG. 2 view is a snapshot in an instant of time since the mobile is in continuos rotation.

Figure 3:
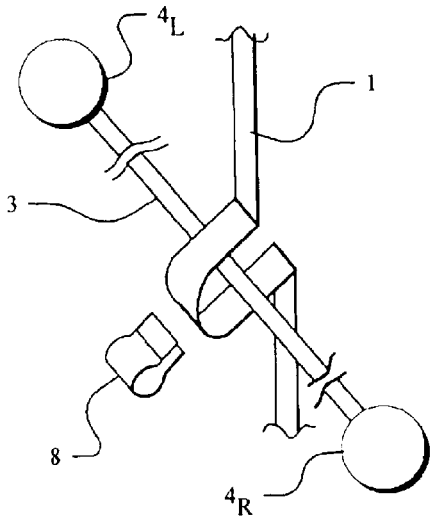
FIG. 3 is a perspective view of the clip, rib and spine assembly for fastening one rib to the spine.

In FIG. 3, a perspective view of the clip 8, rib 3 and spine 1 assembly is shown in exploded view form. The clip 8 is pressed over the rounded portion of the spine 1 and around the rib 3 for fastening the rib 3 to the spine 1. For assembly, the spine has a portion formed generally in a U shape with an opening at the top of the U. The bottom of the U is pushed into the clip and over the rib. The clip has enough spring strength to keep the rib trapped in the spring without slippage of the rib. The clip is made so that the width of the rib and two layers or the spine can be pushed inside the clip and held tightly. The clip is preferably made from spring steel but can be made from other fastening materials. The clip 8 is generally the same width as the spine 1.

The mobile is typically assembled in a jig made of aluminum, stainless steel or any material that is rigid and strong. The jig is generally in the shape of a solid rectangle, longest in length, second in height, and shortest in width. This jig has a channel for the spine 1 down the center having the same width as the material used for the spine of the mobile. The jig has rib slots for the placement of the ribs 3 that run perpendicular to the spine 1. Within this rib slot is a smaller clip slot where the clip 8 that attaches the rib to the spine 1 is centered and held upright. The clip slot is centered within the rib slot. The number of slots for clips 8 matches the number of ribs 3. The clip is placed and centered into the clip slot. The material for the spine is placed in the spine channel. Then, each rib is placed into a rib slot, centered either by balance or measurement and then pushed down into the clip, pushing the spine down so that the clip 8 sandwiches the rib 3 cased by the spine 1. At either end of the jig is a hook slot similar to the rib slot, centered parallel to the length of the jig. This hook slot has a clip slot within it. Into this hook slot the end of the hook 5 that is straight is pushed into a clip so that the hook is firmly attached to the spine. The same is done at the other end after all the ribs have been attached, applying a second hook 6. A hook 5, then, is at the top of the mobile to allow it to be hung. Another hook 6 is at the bottom to be used to attach a weight to the mobile.

Figure 4:
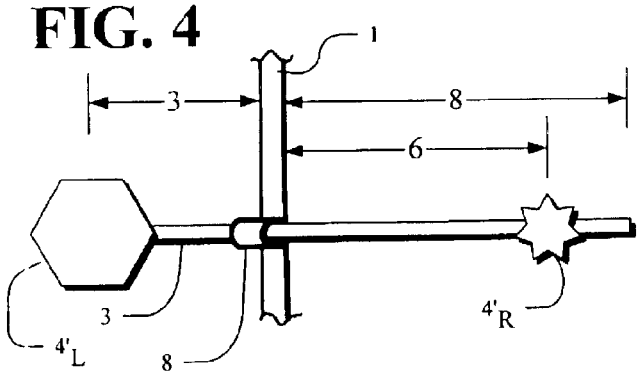
FIG. 4 is a perspective view of the clip, rib and spine assembly for fastening an alternate one rib to the spine where the attachment is offset from the middle and the rib end weights are unequal.

In FIG. 4, a perspective view of the clip 8, rib 3 and spine 1 assembly is shown for fastening a rib to the spine where the attachment location is offset from the middle of the rib. The spine 1 is offset 3 inches from the left side of rib 3 and 8 inches from the right side of rib 3. The rib end weight $\mathbf{4'}_L$ on the left and the rib end weight $\mathbf{4'}_R$ are unequal in weight with the rib end weight $\mathbf{4'}_L$ heavier than the rib end weight $\mathbf{4'}_R$ to compensate for the different offsets from spine 1. Also, the rib end weights are of different shapes. Of course any shape may be selected.

Figure 5:
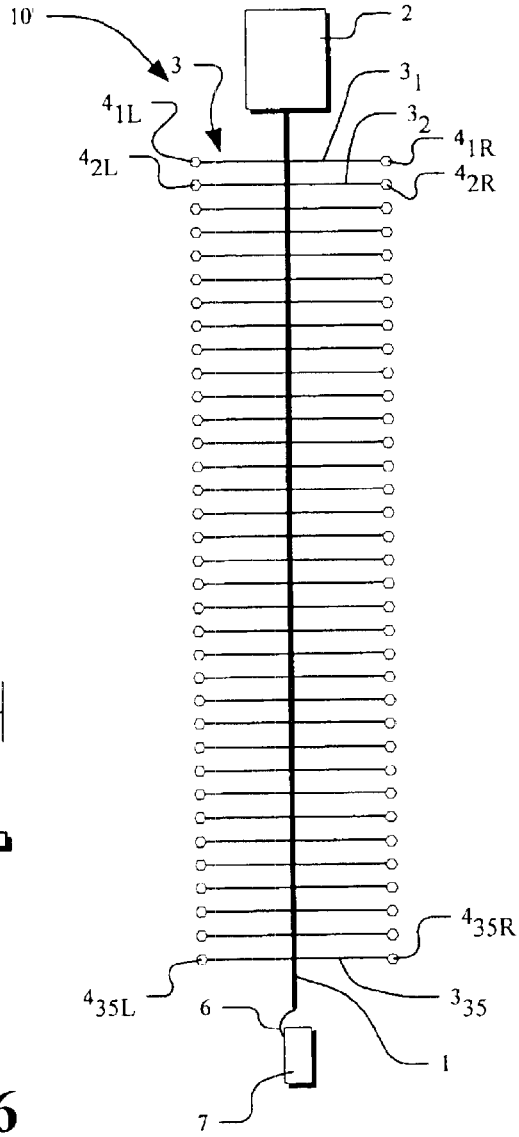
FIG. 5 is a front view of a 35-rib embodiment of a mobile in a stationary position when the motor is off.

FIG. 5 is a front view of a 35-rib embodiment of a mobile 10' in a stationary position when the motor 2 is off. The mobile 10' includes a spine 1 and ribs 3 attached and extending perpendicular to the spine 1. In FIG. 5, the ribs 3 are attached to the torsioning spine 1. The top of the spine 1 is attached to a drive shaft of a motor 2. When the motor 2 is ON, it rotates at about 20 rpm. A hook 6 or similar fastener is located at the bottom of the spine 1 for attachment to a weight 7. The spine 1 is made from an elastic material such as neoprene or other stretchy, rubber-like material. The ribs 3 are made of straight piano wire. At the end of the ribs are rib weights. The ribs 3 are attached and balanced on the spine 1. The spine 1, ribs 3 and weight 7 hang freely and vertically.

In FIG. 5, ribs 3 include the ribs $\mathbf{3}_1, \mathbf{3}_2, \ldots, \mathbf{3}_{35}$. The ribs 3 are 11 inches long and formed of 0.049 inch diameter piano wire. At the ends of the ribs $\mathbf{3}_1, \mathbf{3}_2, \ldots, \mathbf{3}_{35}$ are rib weights $\mathbf{4}_{1L}, \mathbf{4}_{2L}, \ldots, \mathbf{4}_{35L}$ on the left side and rib weights $\mathbf{4}_{1R}, \mathbf{4}_{2R}, \ldots, \mathbf{4}_{35R}$ on the right side each of about 0.83 inch (21 mm) diameter and weighing about 5 grams. The ribs 3 are spaced along the spine 1 with a 1.5 inch spacing so that the spine length between the first rib $\mathbf{3}_1$ and the last rib $\mathbf{3}_{35}$ is about 52.5 inches. The spine extends with a leader portion from the first rib $\mathbf{3}_1$ (typically through a hook not shown) and with a leader portion from the last rib $\mathbf{3}_{35}$ to the hook 6, each leader about 3 inches long, so that the overall length of the spine and hooks is about 6 feet. The spine 1 in the embodiment of FIG. 5 is neoprene measuring about ⅜ inch wide and 1/32 inch thick and having a hardness of 50 durometer. The weight 7 adds enough weight to assist in straightening the spine 1 and attached ribs 3. In the embodiment of FIG. 5, the weight 7 is about 28 grams. The drive motor 2 in the embodiment of FIG. 5 is electrically powered (from batteries or 3 volt power supply).

Figure 6:
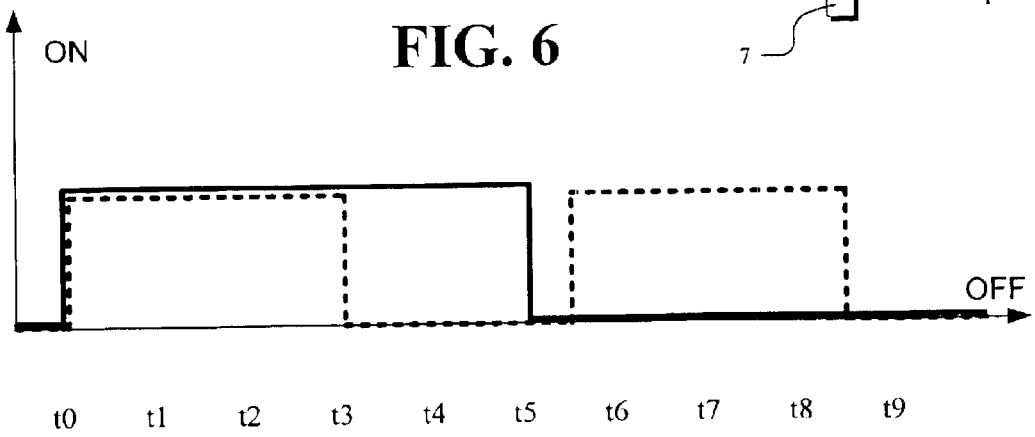
FIG. 6 is a schematic view of the motor sequencing between ON and OFF for driving a mobile.

In FIG. 6, a schematic view of the control signal for sequencing the motor 2 of FIG. 5 between ON and OFF. When the signal is ON, the motor 2 rotates and causes the spine 1 and attached ribs 3 of FIG. 5 to rotate. In FIG. 6, two sequences are shown, one in solid line and the other in broken line. The solid line sequence starts with ON at t0 and runs for 5 minutes until t5 and then returns to OFF. The broken line sequence turns ON at t0, runs for 3 minutes to t3, turns OFF for 2.5 minutes until t5.5 (between t5 and t6), turns ON at t5.5, runs for 3 minutes until t8.5 (between t8 and t9) and then turns OFF. The sequencing timing is related to the dynamic properties of the mobile. In the mobile 10' of FIG. 5, the spine 1 and ribs 3 reach a steady state double helix pattern after about five minutes when starting from a still position with no movement. In the mobile 10' of FIG. 5, the spine 1 and ribs 3 come to a complete stop with no movement in about three minutes when the motor is turned OFF after the mobile has reached a steady state double helix pattern. Therefore, the solid sequence of FIG. 6 extends over the entire natural steady-state cycle from ON to OFF of the mobile 10'. By way of distinction, the broken-line sequence of FIG. 6 interrupts the natural steady-state cycle since, before the mobile is allowed to reach steady state, the motor is turned OFF at t3. This interruption introduces varying wave patterns that propagate up and down the spine 1 and provide different but still pleasing variations of the appearance.

Figure 7:
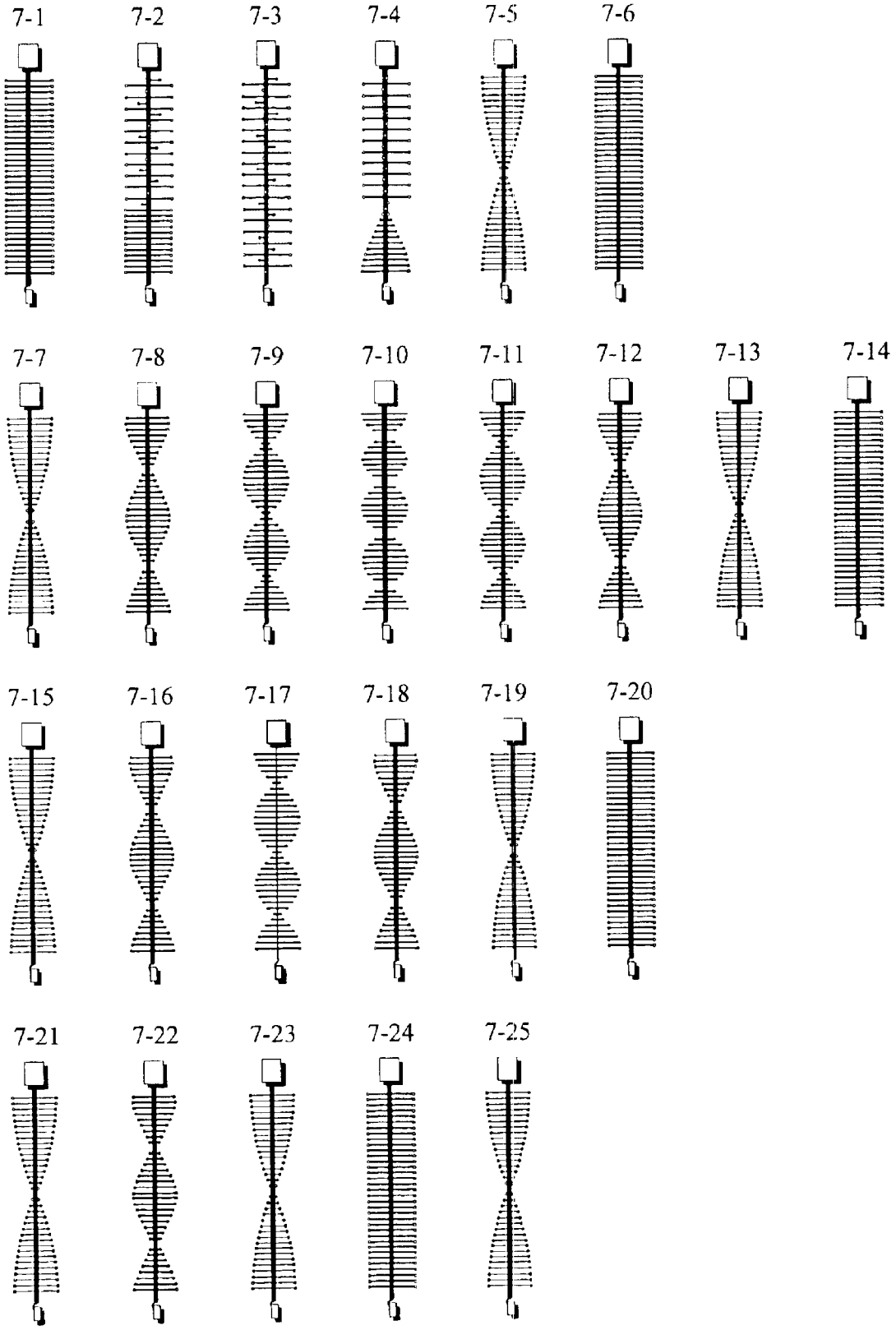
FIG. 7 depicts 27 sequential patterns of the mobile when the motor is turned from OFF to ON allowing the mobile to reach steady state.

FIG. 7 depicts 25 sequential patterns of the mobile which occur after the motor is turned from OFF to ON. The sequential patterns of FIG. 7 represent the transition from a still mobile at 7-1 to the natural steady-state pattern at 7-25. At 7-1, the mobile is stopped and at complete rest and the motor is started. At 7-2, the motor has turned and torqued a portion of the spine leaving the ribs in the torqued portion in an apparently chaotic pattern. The torquing propagates down toward the weight but has not yet reach the weight so that the weight is not yet turning. In 7-3, the torquing has propagated all the way down and the weight just begins to rotate. In 7-4, the weight is increasing in speed and a helix pattern begins to propagate toward the motor but the chaotic pattern still remains above the helix pattern. In 7-5, the helix pattern has progressed to a single node and the momentum from the energy stored in the spine begins to unwind the helix pattern. In 7-6, the helix is unwound to a flat state and begins to form a helix in the opposite direction. In 7-7, the opposite direction helix is formed to a single node. In 7-8, the opposite direction helix is formed to a double node. In 7-9, the opposite direction helix is formed to a triple node. In 7-10, the opposite direction helix is formed to a quadruple node and has finally reached the full extent of the overshoot from the initial stored energy in the helix. In 7-11, 7-12 and 7-13 the helix pattern falls back to triple, double and single nodes until full flat is reached at 7-14. At 7-14, the helix pattern starts to overshoot in the opposite direction climbing to one node at 7-15, two nodes at 7-16 and finally three nodes at 7-17. At 7-17, the helix pattern starts to fall back to two nodes at 7-18, one node at 7-19 and flat at 7-20. At 7-20, an overshoot in the opposite direction occurs progressing to a single node at 7-21, a double node at 7-22 and falling back to a single node at 7-23 an finally flat at 7-24. After 7-24, the helix forms a single node and is in a steady-state and will remain in that state until perturbed or the motor is turned OFF. The whole sequence from 7-1 to 7-25 is approximately 5 minutes (300 seconds) distributed as shown in the following TABLE 1.

TABLE 1

(seconds)

| | | | | | | |
|---|---|---|---|---|---|---|
| 7-1 | 7-2 | 7-3 | 7-4 | 7-5 | 7-6 | 7-7 |
| 0 | 10 | 20 | 28 | 34 | 40 | 45 |
| 7-8 | 7-9 | 7-10 | 7-11 | 7-12 | 7-13 | 7-14 |
| 50 | 55 | 60 | 64 | 68 | 72 | 75 |
| 7-15 | 7-16 | 7-17 | 7-18 | 7-19 | 7-20 | 7-21 |
| 85 | 95 | 105 | 111 | 118 | 125 | 140 |

TABLE 1-continued

| (seconds) | | | |
|---|---|---|---|
| 7-22 | 7-23 | 7-24 | 7-25 |
| 160 | 185 | 230 | 300 |

Figure 8:
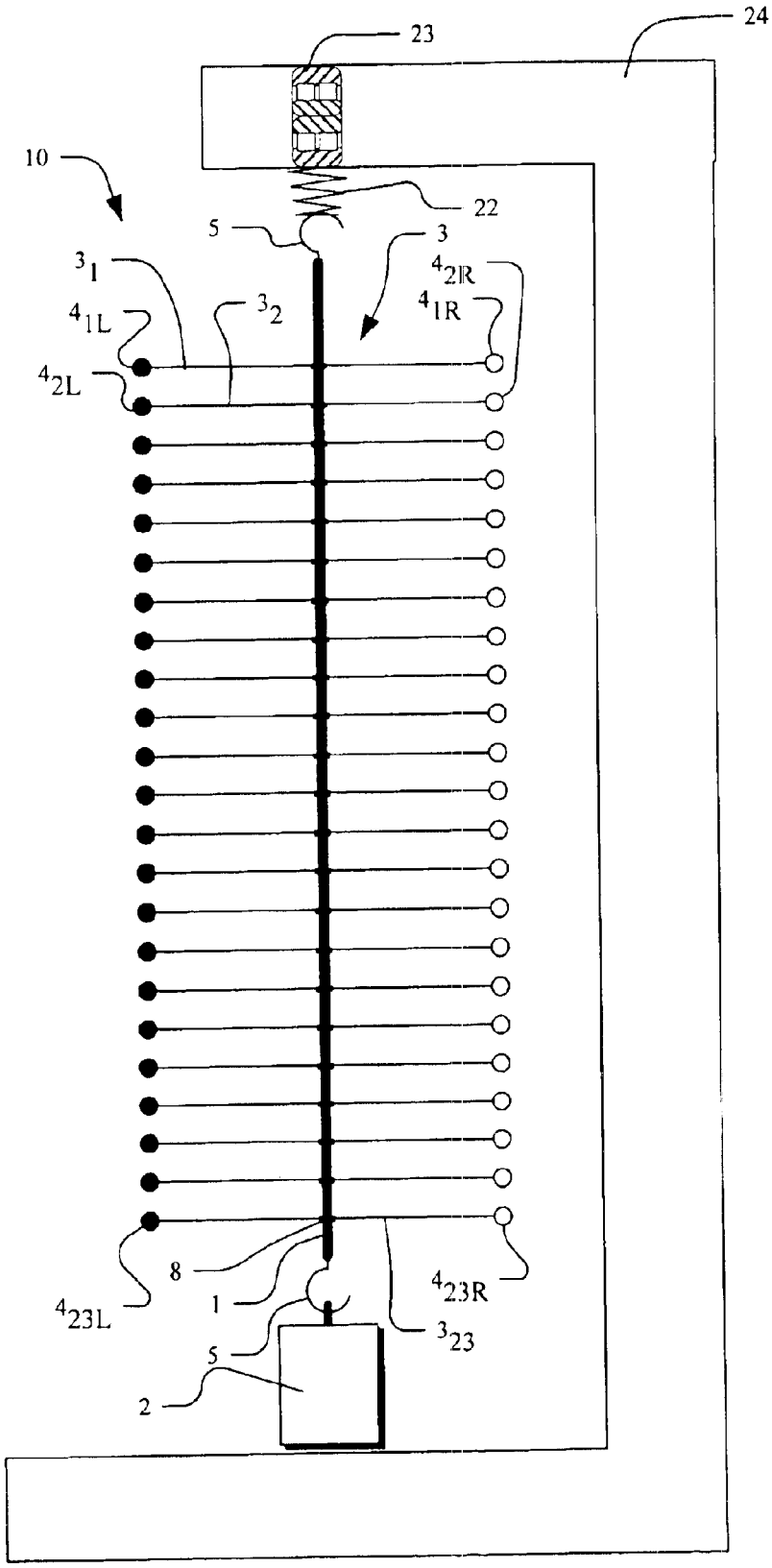
FIG. 8 depicts an alternate embodiment of a mobile with the motor on the bottom and the top attached to a spring on a rotating bearing.

In FIG. 8, an alternate embodiment of a mobile is depicted with the motor 2 on the bottom and the top attached to a spring 22 on a rotating bearing 23 held in a rigid frame 24. The spine 1 extends upwards from the motor 2 and is held vertical by a rotating bearing 23 attached to the member 24 and spring 22.

In operation, the mobile hangs straight on the vertical plumb with all ribs parallel to each other until some energy input is given. A motor is used to drive the spine using either the upper or lower hook. This rotational energy then powers the torsional transmission mobile to stay in constant motion by supplying it with energy causing the mobile to rotate either clockwise or counter clockwise. The kinetic energy keeps a continuous wave moving through the mobile. This wave is further enhanced by using a timer, either mechanical or electrical, to intermittently turn the motor on and off either rhythmically or chaotically. The mobile can be hung from the motor vertically with the mobile free to hang either with a weight at the end or without a weight. The mobile can be hung above the motor with the mobile at the top end attached by a swivel that allows it to rotate while attached to the ceiling or other stationary point. When the mobile is above the source of tension, the mobile must be adjusted properly so the tension that builds is not to strong to break the mobile or so slack as to make rotation impossible or poor. When the motor is used and applied from the top, a weight mayor may not be used. Using a weight creates more tension on the spine of the mobile and tends to keep the ribs parallel and more stable for efficient operation.

Variety in the frequency of the wave when the mobile is hung from a motor may be created by resistance applied to the bottom of the mobile to delay rotation until a greater degree of energy accumulates to release the mobile to rotate again. This resistance may be applied even if the motor is constantly on to create variation in the frequency of oscillation. This is accomplished by connecting a line of some semi-stiff material, as heavy gauge fishing line, to the weight or hook at the lower end of the mobile. There is then a place of resistance, an obstacle, such as a piece of wood, which is located along the track of the line. When the line comes against the mobile during slow rotation it is stopped from further movement, but as the mobile continues to wind because of the rotation of the motor, energy builds until it reaches a point that it breaks through the resistance and the mobile begins rotating freely. It rotates freely until it unwinds and again becomes caught against the place of resistance. This creates additional oscillation patterns that add to the interest of the mobile.

While the invention has been particularly shown and described with reference to preferred embodiments thereof it will be understood by those skilled in the art that various changes in form and details may be made therein without departing from the scope of the invention.

What is claimed is:

1. A mobile comprising:

an elastic spine having a length extending between a first spine end and a second spine end, a plurality of ribs spaced apart along the length of the spine, each rib having a long dimension extending between a first rib end and a second rib end where each rib is attached to the spine between the first rib end and the second rib end, a motor connected to the spine at the first spine end for rotating the spine and the attached ribs to cause the ribs to torque the spine and cause patterns to propagate along the length of the spine.

2. The mobile of claim 1 having a weight attached at the second spine end.

3. The mobile of claim 1 wherein said motor functions to turn ON and OFF with a motor sequence.

4. The mobile of claim 3 wherein said motor sequence is ON for a period that allows the mobile to reach a steady-state.

5. The mobile of claim 3 wherein said motor sequence is not ON long enough for the mobile to reach a steady-state.

6. The mobile of claim 3 wherein said motor sequence is ON and OFF intermittently for periods that are correlated to the natural steady-state cycle from ON to OFF of the mobile.

7. The mobile of claim 1 wherein the spine is made from neoprene.

8. The mobile of claim 1 wherein clips are used to hold the ribs onto the spine.

9. The mobile of claim 1 wherein each the rib has a first rib weight on a first side of the spine having the first rib end and a second rib weight on a second side of the spine having the second rib end.

10. The mobile of claim 9 wherein the first rib weight and the second rib weight weigh the same and are symmetrically mounted on opposite sides of the spine.

11. The mobile of claim 9 wherein the first rib weight and the second rib weight do not weigh the same and are asymmetrically mounted on opposite sides of the spine to compensate for the different weights.

12. The mobile of claim 1 wherein the motor is located at the bottom and the spine extends upwards and is held vertical by a rotating member.

13. The mobile of claim 1 including means for disturbing the rotation of a rib to cause perturbations in the propagation along the spine.

14. The mobile of claim 1 wherein the mobile cycles through helix patterns having one or more nodes.

* * * * *